US011450959B2

(12) United States Patent
Chang et al.

(10) Patent No.: US 11,450,959 B2
(45) Date of Patent: Sep. 20, 2022

(54) MOBILE DEVICE

(71) Applicant: Acer Incorporated, New Taipei (TW)

(72) Inventors: Kun-Sheng Chang, New Taipei (TW); Ching-Chi Lin, New Taipei (TW)

(73) Assignee: ACER INCORPORATED, New Taipei (TW)

( * ) Notice: Subject to any disclaimer, the term of this patent is extended or adjusted under 35 U.S.C. 154(b) by 27 days.

(21) Appl. No.: 17/191,937

(22) Filed: Mar. 4, 2021

(65) Prior Publication Data

US 2022/0094060 A1 Mar. 24, 2022

(30) Foreign Application Priority Data

Sep. 21, 2020 (TW) ..... 109132538

(51) Int. Cl.

| | |
|---|---|
| ***H01Q 1/22*** | (2006.01) |
| ***H01Q 5/307*** | (2015.01) |
| ***H01Q 9/42*** | (2006.01) |

(52) U.S. Cl.

CPC ..... *H01Q 5/307* (2015.01); *H01Q 9/42* (2013.01); *H01Q 1/2266* (2013.01)

(58) Field of Classification Search

CPC ..... H01Q 1/2266; H01Q 9/42; H01Q 5/307

See application file for complete search history.

(56) References Cited

U.S. PATENT DOCUMENTS 10,193,597 B1 * 1/2019 Garrido Lopez ..... H04B 1/38

* cited by examiner

*Primary Examiner* — Graham P Smith

(74) *Attorney, Agent, or Firm* — McClure, Qualey & Rodack, LLP

(57) ABSTRACT

A mobile device includes a metal mechanism element, a first radiation element, a second radiation element, a third radiation element, a fourth radiation element, a fifth radiation element, and a dielectric substrate. The metal mechanism element has a first closed slot and a second closed slot, which are separated from one another. The first radiation element is coupled to a signal source, and extends across the first closed slot. The second radiation element is floating. The third radiation element is coupled to a ground voltage. The fourth radiation element is coupled to the ground voltage, and is positioned between the first closed slot and the second closed slot. An antenna structure is formed by the first radiation element, the second radiation element, the third radiation element, the fourth radiation element, the fifth radiation element, the first closed slot, and the second closed slot of the metal mechanism element.

15 Claims, 7 Drawing Sheets

700

MOBILE DEVICE

CROSS REFERENCE TO RELATED APPLICATIONS

This application claims priority of Taiwan Patent Application No. 109132538 filed on Sep. 21, 2020, the entirety of which is incorporated by reference herein.

BACKGROUND OF THE INVENTION

Field of the Invention

The disclosure generally relates to a mobile device, and more particularly, it relates to a mobile device and an antenna structure therein.

Description of the Related Art

With the advancements being made in mobile communication technology, mobile devices such as portable computers, mobile phones, multimedia players, and other hybrid functional portable electronic devices have become more common. To satisfy user demand, mobile devices can usually perform wireless communication functions. Some devices cover a large wireless communication area; these include mobile phones using 2G, 3G, and LTE (Long Term Evolution) systems and using frequency bands of 700 MHz, 850 MHz, 900 MHz, 1800 MHz, 1900 MHz, 2100 MHz, 2300 MHz, and 2500 MHz. Some devices cover a small wireless communication area; these include mobile phones using Wi-Fi and Bluetooth systems and using frequency bands of 2.4 GHz, 5.2 GHz, and 5.8 GHz.

In order to improve their appearance, designers often incorporate metal elements into mobile devices. However, these newly added metal elements tend to negatively affect the antennas used for wireless communication in mobile devices, thereby degrading the overall communication quality of the mobile devices. As a result, there is a need to propose a mobile device with a novel antenna structure, so as to overcome the problems of the prior art.

BRIEF SUMMARY OF THE INVENTION

In an exemplary embodiment, the disclosure is directed to a mobile device that includes a metal mechanism element, a first radiation element, a second radiation element, a third radiation element, a fourth radiation element, a fifth radiation element, and a dielectric substrate. The metal mechanism element has a first closed slot and a second closed slot which are separate from each other. The first radiation element is coupled to a signal source. The first radiation element extends across the first closed slot. The second radiation element is floating, and extends across the first closed slot. The third radiation element is coupled to a ground voltage. The third radiation element is adjacent to the first closed slot. The fourth radiation element is coupled to the ground voltage. The fourth radiation element is positioned between the first closed slot and the second closed slot. The fifth radiation element is coupled to the ground voltage. The fifth radiation element is adjacent to the second closed slot. The dielectric substrate is disposed adjacent to the metal mechanism element. The first radiation element, the second radiation element, the third radiation element, the fourth radiation element, and the fifth radiation element are all disposed on the dielectric substrate. An antenna structure is formed by the first radiation element, the second radiation element, the third radiation element, the fourth radiation element, the fifth radiation element, and the first closed slot and the second closed slot of the metal mechanism element.

In some embodiments, the first closed slot substantially has a long straight-line shape, and the second closed slot substantially has a short straight-line shape.

In some embodiments, the first radiation element substantially has an inverted L-shape, and the fourth radiation element substantially has an L-shape.

In some embodiments, the fourth radiation element has a vertical projection on the metal mechanism element, and the vertical projection overlaps neither the first closed slot nor the second closed slot.

In some embodiments, the third radiation element does not extend across the first closed slot at all, and the fifth radiation element at least partially extends across the second closed slot.

In some embodiments, the distance between the first closed slot and the second closed slot is shorter than or equal to 2.5 mm.

In some embodiments, a coupling gap is formed between the fourth radiation element and the first radiation element, and the width of the coupling gap is shorter than or equal to 1 mm.

In some embodiments, the antenna structure covers a first frequency band from 2400 MHz to 2500 MHz, a second frequency band from 5150 MHz to 5850 MHz, and a third frequency band from 5925 MHz to 7125 MHz.

In some embodiments, the length of the first closed slot is substantially equal to 0.5 wavelength of the first frequency band.

In some embodiments, the length of the second closed slot is substantially equal to 0.5 wavelength of the third frequency band.

BRIEF DESCRIPTION OF DRAWINGS

The invention can be more fully understood by reading the subsequent detailed description and examples with references made to the accompanying drawings, wherein.

DETAILED DESCRIPTION OF THE INVENTION

In order to illustrate the purposes, features and advantages of the invention, the embodiments and figures of the invention are shown in detail as follows.

Certain terms are used throughout the description and following claims to refer to particular components. As one skilled in the art will appreciate, manufacturers may refer to a component by different names. This document does not intend to distinguish between components that differ in name but not function. In the following description and in the claims, the terms "include" and "comprise" are used in an open-ended fashion, and thus should be interpreted to mean "include, but not limited to . . . ". The term "substantially" means the value is within an acceptable error range. One skilled in the art can solve the technical problem within a predetermined error range and achieve the proposed technical performance. Also, the term "couple" is intended to mean either an indirect or direct electrical connection. Accordingly, if one device is coupled to another device, that connection may be through a direct electrical connection, or through an indirect electrical connection via other devices and connections.

Figure 1:
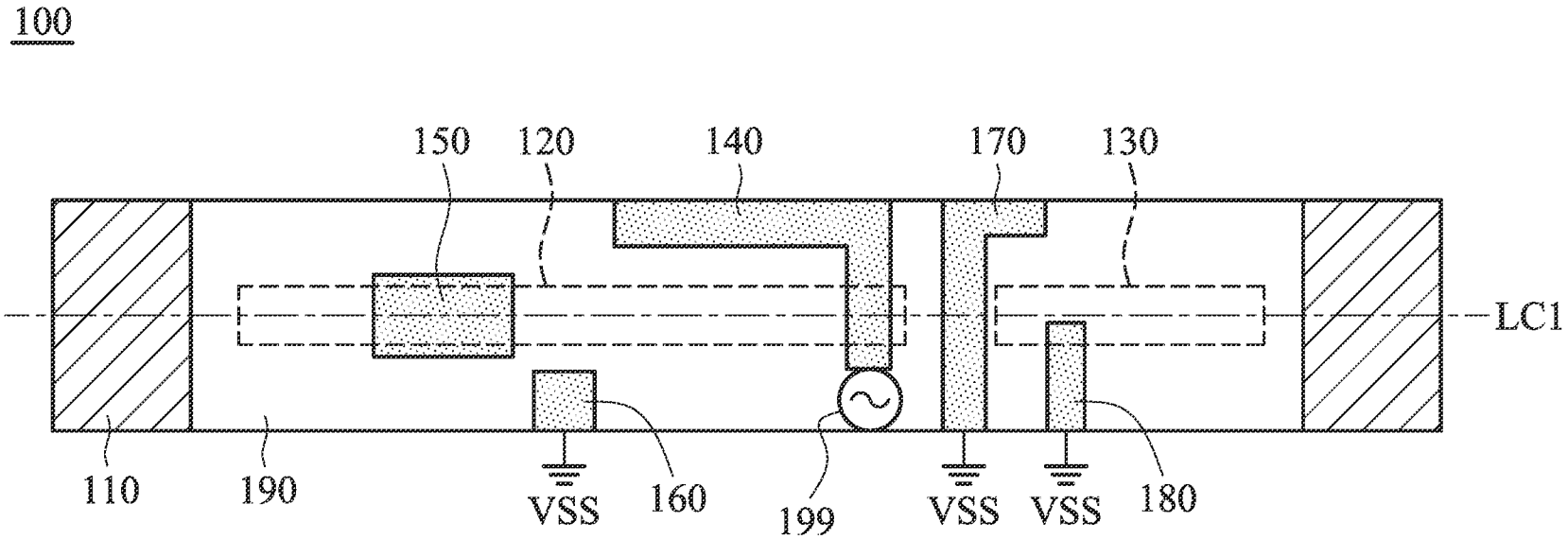
FIG. 1 is a perspective view of a mobile device according to an embodiment of the invention.
Figure 2:
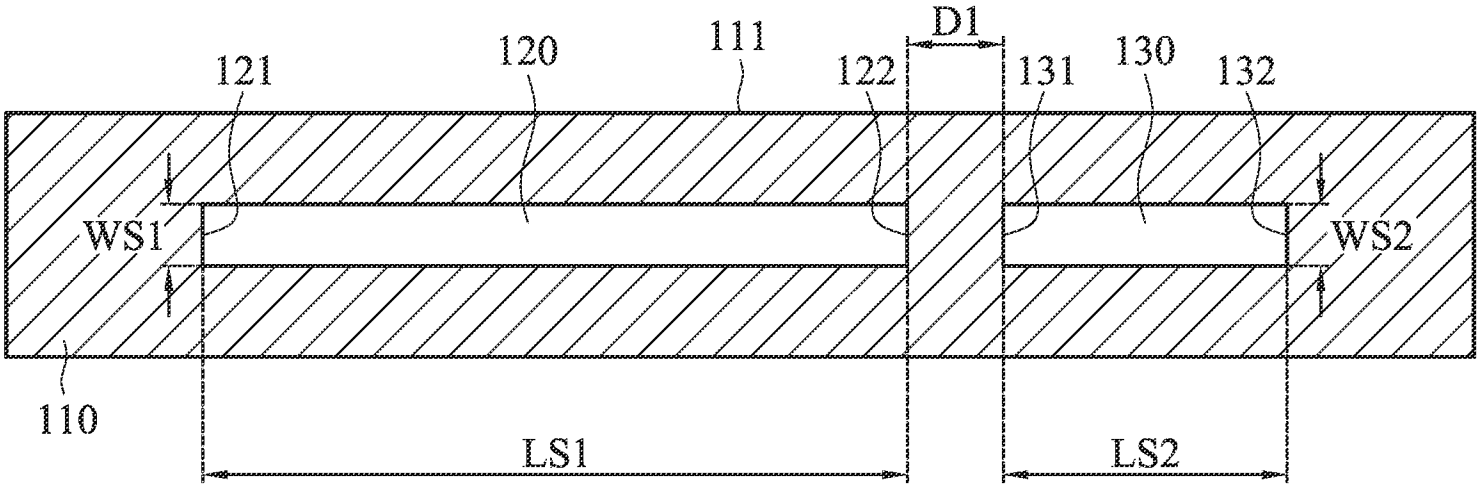
FIG. 2 is a view of lower-layer portions of a mobile device according to an embodiment of the invention.
Figure 3:
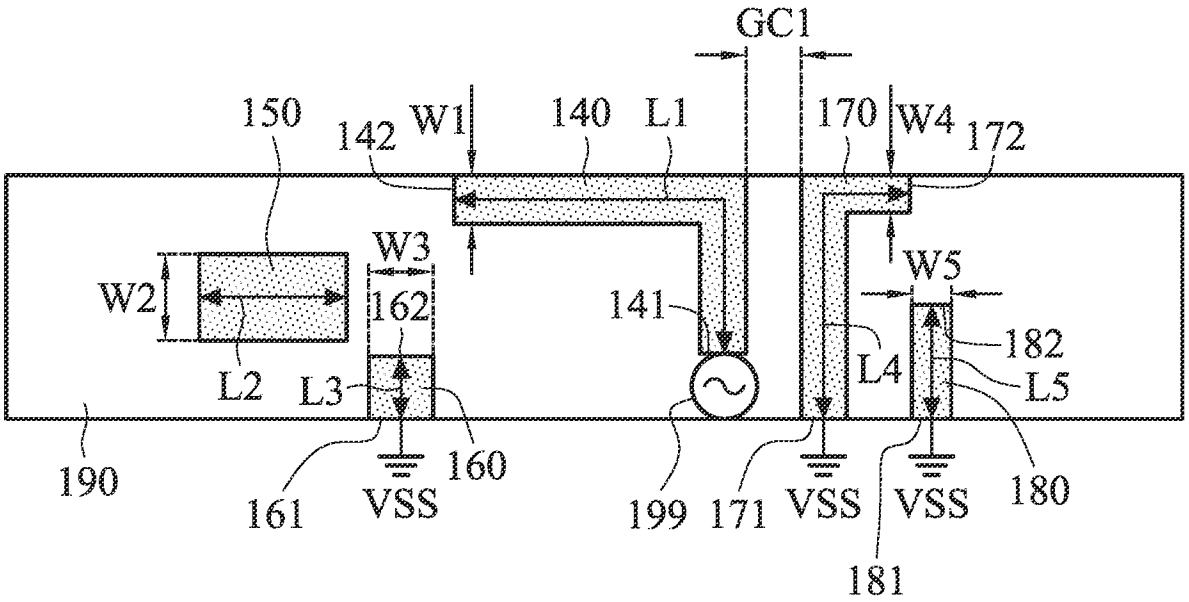
FIG. 3 is a view of upper-layer portions of a mobile device according to an embodiment of the invention.
Figure 4:
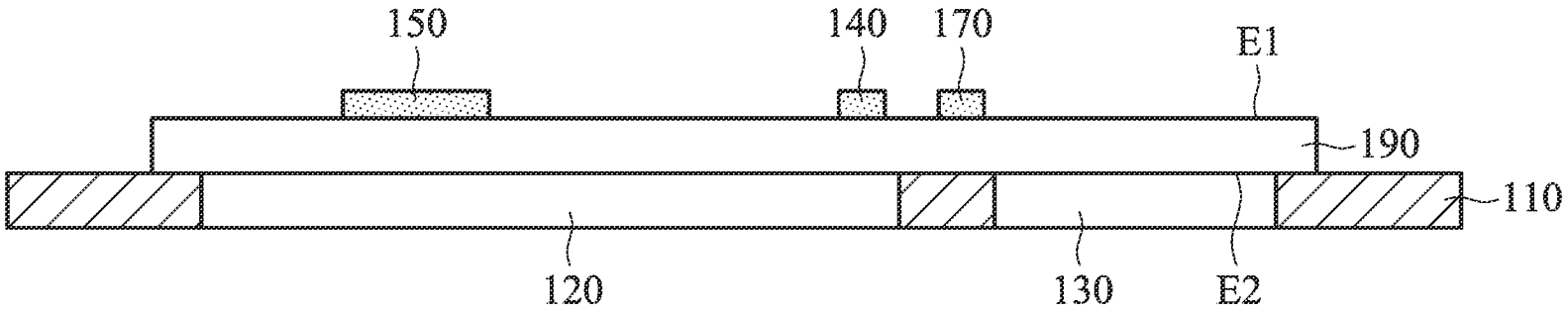
FIG. 4 is a sectional view of a mobile device according to an embodiment of the invention.

FIG. 1 is a perspective view of a mobile device 100 according to an embodiment of the invention. FIG. 2 is a view of lower-layer portions of the mobile device 100 according to an embodiment of the invention. FIG. 3 is a view of upper-layer portions of the mobile device 100 according to an embodiment of the invention. FIG. 4 is a sectional view of the mobile device 100 according to an embodiment of the invention (along a sectional line LC1 of FIG. 1). Please refer to FIG. 1, FIG. 2, FIG. 3, and FIG. 4 together. The mobile device 100 may be a smartphone, a tablet computer, or a notebook computer. In the embodiment of FIG. 1, FIG. 2, FIG. 3, and FIG. 4, the mobile device 100 includes a metal mechanism element 110, a first radiation element 140, a second radiation element 150, a third radiation element 160, a fourth radiation element 170, a fifth radiation element 180, and a dielectric substrate 190. It should be understood that the mobile device 100 may further includes other components, such as a processor, a touch control panel, a speaker, a battery module, and a housing, although they are not displayed in FIG. 1, FIG. 2, FIG. 3, and FIG. 4.

The metal mechanism element 110 may be an appearance element of the mobile device 100. It should be noted that the so-called "appearance element" over the disclosure means a portion of the mobile device 100 which eyes of users can directly observe. In some embodiments, the metal mechanism element 110 is a metal upper cover of a notebook computer, or a metal back cover of a tablet computer, but it is not limited thereto. For example, if the mobile device 100 is a notebook computer, the metal mechanism element 110 may be the so-called "A-component" in the field of notebook computers. The metal mechanism element 110 has a first closed slot 120 and a second closed slot 130 which are completely separate from each other. For example, the first closed slot 120 may substantially have a relatively long straight-line shape, and the second closed slot 130 may substantially have a relatively short straight-line shape. The first closed slot 120 and the second closed slot 130 may be arranged in the same straight line, and they may be both substantially parallel to an edge 111 of the metal mechanism element 110. Specifically, the first closed slot 120 has a first closed end 121 and a second closed end 122 which are away from each other. The second closed slot 130 has a third closed end 131 and a fourth closed end 132 which are away from each other. The third closed end 131 of the second closed slot 130 is adjacent to the second closed end 122 of the first closed slot 120. The mobile device 100 may also include a nonconductive material which fills both the first closed slot 120 and the second closed slot 130 of the metal mechanism element 110, so as to provide effective waterproofing or dustproofing.

The first radiation element 140, the second radiation element 150, the third radiation element 160, the fourth radiation element 170, and the fifth radiation element 180 may all be made of metal materials, such as copper, silver, aluminum, iron, or their alloys. The dielectric substrate 190 may be an FR4 (Flame Retardant 4) substrate, a PCB (Printed Circuit Board), or an FPC (Flexible Printed Circuit). The dielectric substrate 190 has a first surface E1 and a second surface E2 which are opposite to each other. The first radiation element 140, the second radiation element 150, the third radiation element 160, the fourth radiation element 170, and the fifth radiation element 180 may all be disposed on the first surface E1 of the dielectric substrate 190. The second surface E2 of the dielectric substrate 190 is adjacent the metal mechanism element 110. It should be noted that the term "adjacent" or "close" over the disclosure means that the distance (spacing) between two corresponding elements is smaller than a predetermined distance (e.g., 5 mm or shorter), or means that the two corresponding elements directly touch each other (i.e., the aforementioned distance/spacing therebetween is reduced to 0). In some embodiments, the second surface E2 of the dielectric substrate 190 directly touches the metal mechanism element 110. As a result, the dielectric substrate 190 can completely cover the first closed slot 120 and the second closed slot 130.

A ground voltage VSS of the mobile device 100 may be provided by a ground element (not shown), and the ground element may be coupled to the metal mechanism element 110. For example, the ground element may be a ground copper foil, which may extend from the dielectric substrate 190 onto the metal mechanism element 110.

The first radiation element 140 may substantially have an inverted L-shape, and it can extend across the first closed slot 120. Specifically, the first radiation element 140 has a first end 141 and a second end 142. The first end 141 of the first radiation element 140 is coupled to a signal source 199. The second end 142 of the first radiation element 140 is an open end. For example, the signal source 199 may be an RF (Radio Frequency) module. In some embodiments, the first radiation element 140 has a vertical projection on the metal mechanism element 110, and the vertical projection of the first radiation element 140 at least partially overlaps the first closed slot 120.

The second radiation element 150 may substantially have a rectangular shape. The second radiation element 150 is floating, and it can extend across the first closed slot 120. That is, the second radiation element 150 does not touch the metal mechanism element 110 or any radiation element. In some embodiments, the second radiation element 150 has a vertical projection on the metal mechanism element 110, and the vertical projection of second radiation element 150 at least partially overlaps the first closed slot 120.

The third radiation element 160 may substantially have a straight-line shape, which may be disposed between the first radiation element 140 and the second radiation element 150. Specifically, the third radiation element 160 has a first end 161 and a second end 162. The first end 161 of the third radiation element 160 is coupled to the ground voltage VSS. The second end 162 of the third radiation element 160 is an open end, which is adjacent to the first closed slot 120. The whole third radiation element 160 does not extend across the first closed slot 120. In some embodiments, the third radiation element 160 has a vertical projection on the metal mechanism element 110, and the vertical projection of the third radiation element 160 does not overlap the first closed slot 120 at all.

The fourth radiation element 170 may substantially have an L-shape, which may be disposed between the first closed slot 120 and the second closed slot 130 (or may be disposed between the first radiation element 140 and the fifth radiation element 180). Specifically, the fourth radiation element 170 has a first end 171 and a second end 172. The first end 171 of the fourth radiation element 170 is coupled to the ground voltage VSS. The second end 172 of the fourth radiation element 170 is an open end. The second end 172 of the fourth radiation element 170 and the second end 142 of the first radiation element 140 may substantially extend in opposite directions and away from each other. In addition, the fourth radiation element 170 is adjacent to the first radiation element 140. As a result, a coupling gap GC1 is formed between the fourth radiation element 170 and the first radiation element 140. In some embodiments, the fourth radiation element 170 has a vertical projection on the metal mechanism element 110, and the vertical projection of the fourth radiation element 170 overlaps neither the first closed slot 120 nor the second closed slot 130.

The fifth radiation element 180 may substantially have a straight-line shape, and it may be at least partially parallel to the fourth radiation element 170. Specifically, the fifth radiation element 180 has a first end 181 and a second end 182. The first end 181 of the fifth radiation element 180 is coupled to the ground voltage VSS. The second end 182 of the fifth radiation element 180 is an open end, which is adjacent to the second closed slot 130. The fifth radiation element 180 at least partially extends the second closed slot 130. In some embodiments, the fifth radiation element 180 has a vertical projection on the metal mechanism element 110, and the vertical projection of the fifth radiation element 180 at least partially overlaps the second closed slot 130. On the other hand, the vertical projection of the second end 182 of the fifth radiation element 180 may be exactly positioned inside the second closed slot 130.

In a preferred embodiment, an antenna structure of the mobile device 100 is formed by the first radiation element 140, the second radiation element 150, the third radiation element 160, the fourth radiation element 170, the fifth radiation element 180, and the first closed slot 120 and the second closed slot 130 of the metal mechanism element 110.

Figure 5:
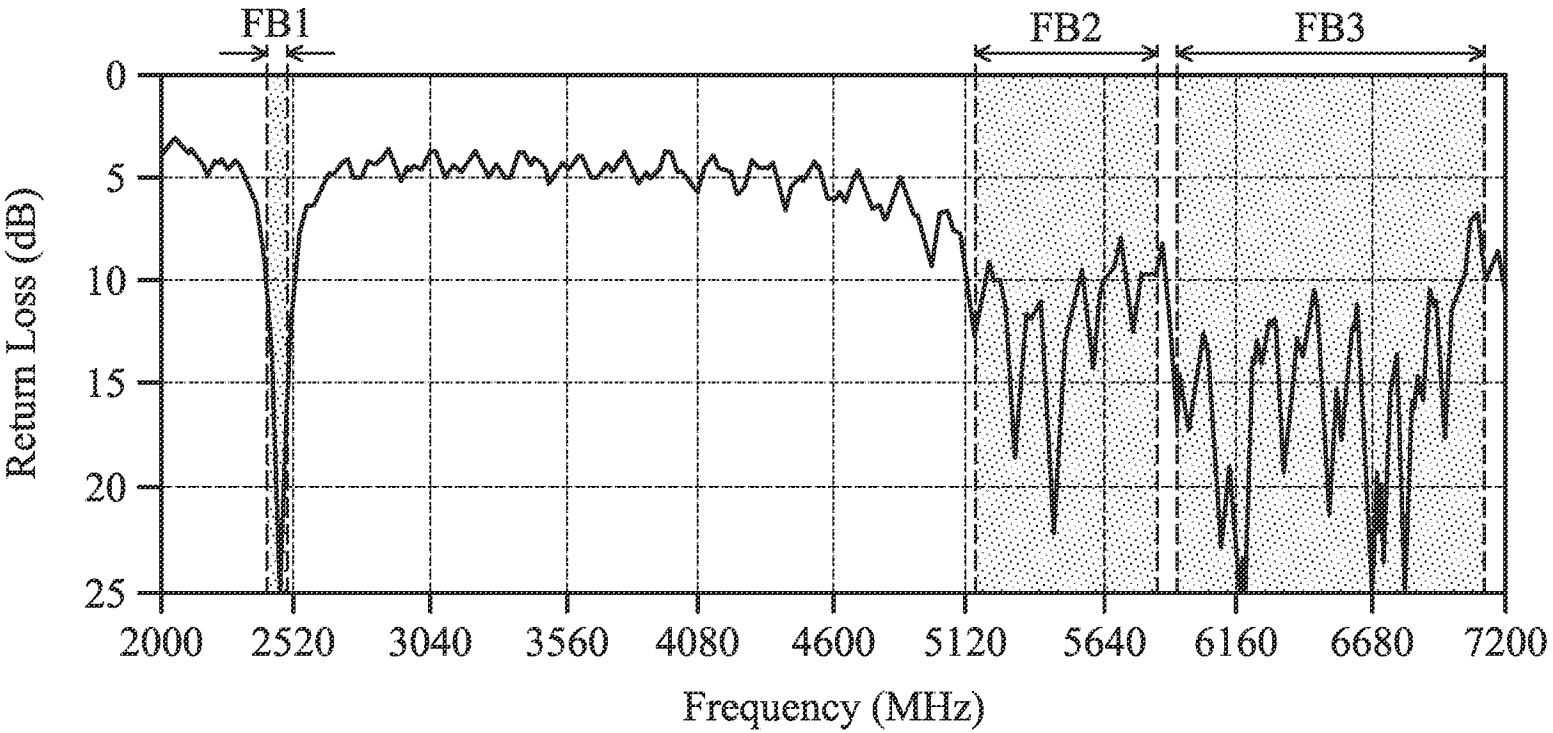
FIG. 5 is a diagram of return loss of an antenna structure of a mobile device according to an embodiment of the invention.

FIG. 5 is a diagram of return loss of the antenna structure of the mobile device 100 according to an embodiment of the invention. The horizontal axis represents operation frequency (MHz), and the vertical axis represents the return loss (dB). According to the measurement of FIG. 5, when being excited by the signal source 199, the antenna structure of the mobile device 100 can cover a first frequency band FB1, a second frequency band FB2, and a third frequency band FB3. For example, the first frequency band FB1 may be from 2400 MHz to 2500 MHz, the second frequency band FB2 may be from 5150 MHz to 5850 MHz, and the third frequency band FB3 may be from 5925 MHz to 7125 MHz. Thus, the antenna structure of the mobile device 100 can support at least the wideband operations of the conventional WLAN (Wireless Wide Area Network) 2.4 GHz/5 GHz and the next generation Wi-Fi 6.

With respect to the antenna theory, the first radiation element 140 and the first closed slot 120 of the metal mechanism element 110 are excited to generate a fundamental resonant mode, thereby forming the aforementioned first frequency band FB1. Furthermore, the first radiation element 140 and the first closed slot 120 of the metal mechanism element 110 are also excited to generate a higher-order resonant mode (double-frequency effect), thereby forming the aforementioned second frequency band FB2. On the other hand, the fourth radiation element 170 and the second closed slot 130 of the metal mechanism element 110 are excited by the first radiation element 140 using a coupling mechanism, thereby forming the aforementioned third frequency band FB3. According to practical measurements, the incorporation of the second radiation element 150, the second radiation element 160, and the fifth radiation element 180 can help to fine-tune the impedance matching of the first frequency band FB1, the second frequency band FB2, and the third frequency band FB3.

Figure 6:
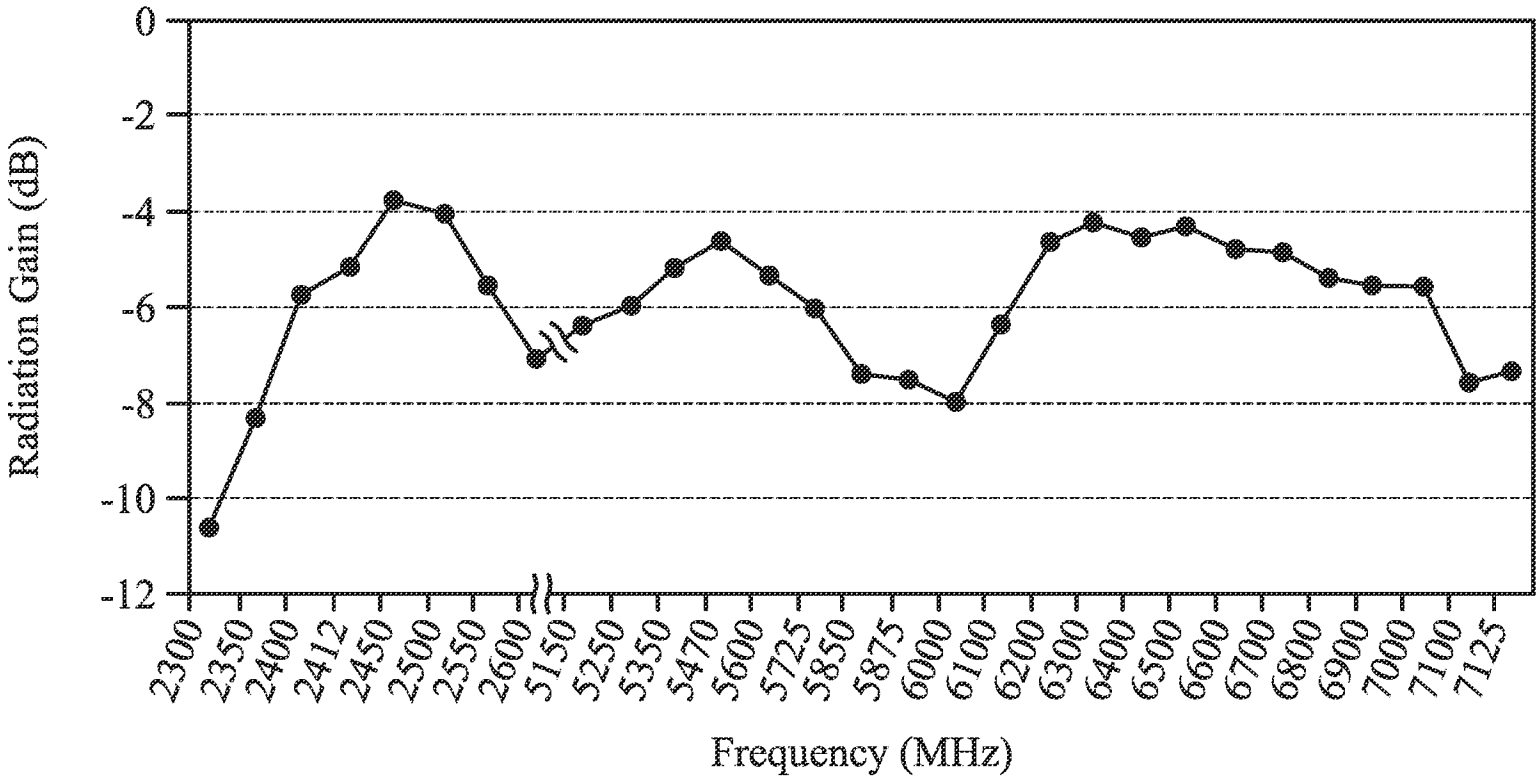
FIG. 6 is a diagram of radiation gain of an antenna structure of a mobile device according to an embodiment of the invention.

FIG. 6 is a diagram of radiation gain of the antenna structure of the mobile device 100 according to an embodiment of the invention. The horizontal axis represents operation frequency (MHz), and the vertical axis represents the radiation gain (dB). According to the measurement of FIG. 6, the radiation gain of the antenna structure of the mobile device 100 can reach −6 dB or higher within the first frequency band FB1, the second frequency band FB2, and the third frequency band FB3, and it can meet the requirements of practical application of the conventional WLAN and the next generation Wi-Fi 6.

In some embodiments, the element sizes of the mobile device 100 are as follows. The length LS1 of the first closed slot 120 may be substantially equal to 0.5 wavelength (λ/2) of the first frequency band FB1 of the antenna structure of the mobile device 100. The width WS1 of the first closed slot 120 may be from 2 mm to 2.5 mm. The length LS2 of the second closed slot 130 may be substantially equal to 0.5 wavelength (λ/2) of the third frequency band FB3 of the antenna structure of the mobile device 100. The width WS2 of the second closed slot 130 may be from 2 mm to 2.5 mm. The distance D1 between the first closed slot 120 and the second closed slot 130 may be shorter than or equal to 2.5 mm. The length L1 of the first radiation element 140 may be longer than or equal to 10 mm. The width W1 of the first radiation element 140 may be from 0.5 mm to 2 mm. The length L2 of the second radiation element 150 may be from 4 mm to 6 mm. The width W2 of the second radiation element 150 may be from 2 mm to 3 mm. The length L3 of the third radiation element 160 may be from 1 mm to 3 mm. The width W3 of the third radiation element 160 may be from 1 mm to 3 mm. The length L4 of the fourth radiation element 170 may be longer than or equal to 6 mm. The width W4 of the fourth radiation element 170 may be from 0.5 mm to 2 mm. The length L5 of the fifth radiation element 180 may be longer than or equal to 5 mm. The width W5 of the fifth radiation element 180 may be from 0.5 mm to 2 mm. The width of the coupling gap GC1 between the first radiation element 140 and the fourth radiation element 170 may be shorter than or equal to 1 mm. The above ranges of element sizes are calculated and obtained according to the results of many experiments, and they help to optimize the operation bandwidth and impedance matching of the antenna structure of the mobile device 100.

Figure 7:
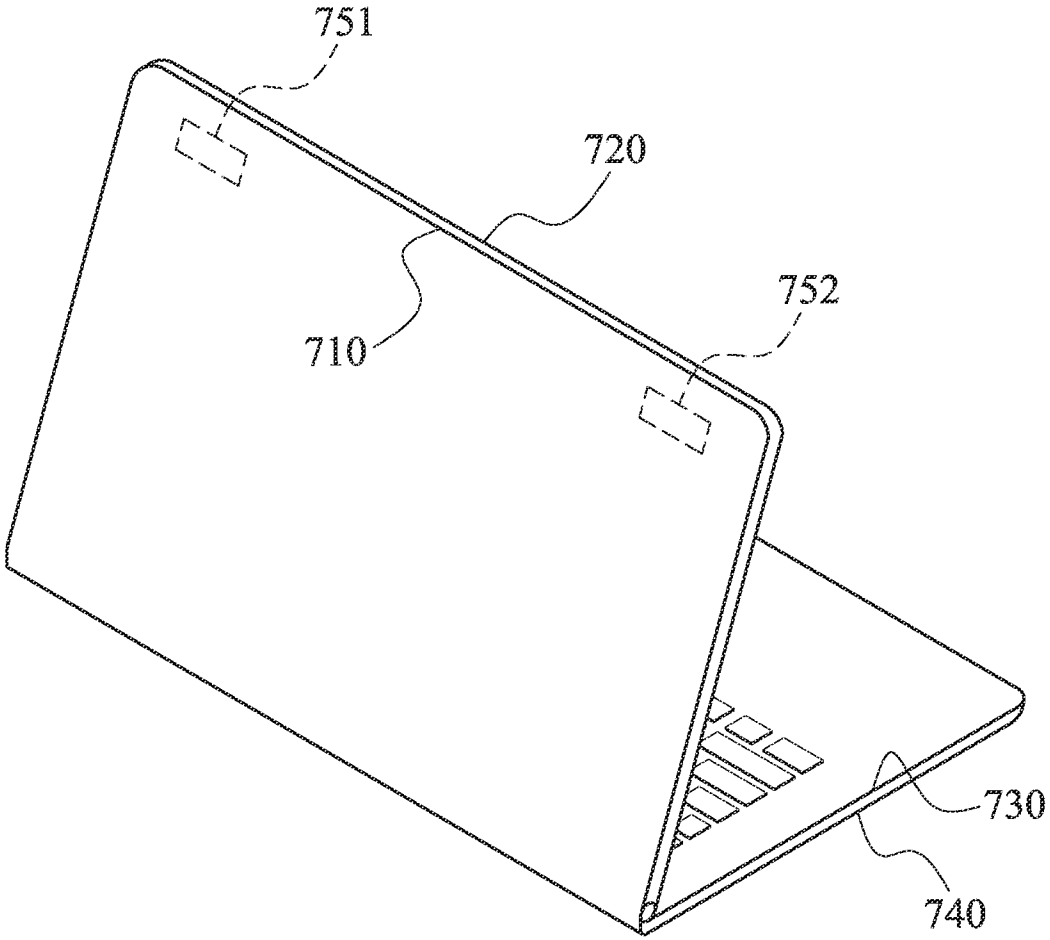
FIG. 7 is a view of a notebook computer according to an embodiment of the invention.

FIG. 7 is a view of a notebook computer 700 according to an embodiment of the invention. In the embodiment of FIG. 7, the aforementioned antenna structure can be applied in the notebook computer 700. The notebook computer 700 includes an upper cover housing 710, a display frame 720, a keyboard frame 730, and a base housing 740. It should be understood that the upper cover housing 710, the display frame 720, the keyboard frame 730, and the base housing 740 are equivalent to the so-called "A-component", "B-component", "C-component", and "D-component" in the field of notebook computers, respectively. The aforementioned antenna structure may be disposed at a first position 751 and/or a second position 752 of the notebook computer 700. In other words, the antenna structure of the invention can be integrated with the conductive upper cover housing 710 of the notebook computer 700. It not only improves the device appearance but also maintains good communication quality.

The invention proposes a novel mobile device and a novel antenna structure, which may be integrated with a metal mechanism element. Since the metal mechanism element is considered as an extension portion of the antenna structure, it does not negatively affect the radiation performance of the antenna structure. Compared to the conventional design, the invention has at least the advantages of small size, wide bandwidth, low manufacturing cost, and beautiful device appearance, and therefore it is suitable for application in a variety of mobile communication devices.

Note that the above element sizes, element shapes, element parameters, and frequency ranges are not limitations of the invention. An antenna designer can fine-tune these settings or values according to different requirements. It should be understood that the mobile device and antenna structure of the invention are not limited to the configurations of FIGS. 1-7. The invention may merely include any one or more features of any one or more embodiments of FIGS. 1-7. In other words, not all of the features displayed in the figures should be implemented in the mobile device and antenna structure of the invention.

Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having the same name (but for use of the ordinal term) to distinguish the claim elements.

While the invention has been described by way of example and in terms of the preferred embodiments, it should be understood that the invention is not limited to the disclosed embodiments. On the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A mobile device, comprising:

a metal mechanism element, having a first closed slot and a second closed slot separate from each other;

a first radiation element, coupled to a signal source, wherein the first radiation element extends across the first closed slot;

a second radiation element, wherein the second radiation element is floating and extends across the first closed slot;

a third radiation element, coupled to a ground voltage, wherein the third radiation element is adjacent to the first closed slot;

a fourth radiation element, coupled to the ground voltage, wherein the fourth radiation element is positioned between the first closed slot and the second closed slot;

a fifth radiation element, coupled to the ground voltage, wherein the fifth radiation element is adjacent to the second closed slot; and a dielectric substrate, disposed adjacent to the metal mechanism element, wherein the first radiation element, the second radiation element, the third radiation element, the fourth radiation element, and the fifth radiation element are all disposed on the dielectric substrate;

wherein an antenna structure is formed by the first radiation element, the second radiation element, the third radiation element, the fourth radiation element, the fifth radiation element, and the first closed slot and the second closed slot of the metal mechanism element.

2. The mobile device as claimed in claim 1, wherein the first closed slot substantially has a long straight-line shape.

3. The mobile device as claimed in claim 1, wherein the second closed slot substantially has a short straight-line shape.

4. The mobile device as claimed in claim 1, wherein the first radiation element substantially has an inverted L-shape.

5. The mobile device as claimed in claim 1, wherein the fourth radiation element substantially has an L-shape.

6. The mobile device as claimed in claim 1, wherein the fourth radiation element has a vertical projection on the metal mechanism element, and the vertical projection overlaps neither the first closed slot nor the second closed slot.

7. The mobile device as claimed in claim 1, wherein the third radiation element does not extend across the first closed slot at all.

8. The mobile device as claimed in claim 1, wherein the fifth radiation element at least partially extends across the second closed slot.

9. The mobile device as claimed in claim 1, wherein a distance between the first closed slot and the second closed slot is shorter than or equal to 2.5 mm.

10. The mobile device as claimed in claim 1, wherein a coupling gap is formed between the fourth radiation element and the first radiation element.

11. The mobile device as claimed in claim 10, wherein a width of the coupling gap is shorter than or equal to 1 mm.

12. The mobile device as claimed in claim 1, wherein the antenna structure covers a first frequency band, a second frequency band, and a third frequency band.

13. The mobile device as claimed in claim 12, wherein the first frequency band is from 2400 MHz to 2500 MHz, the second frequency band is from 5150 MHz to 5850 MHz, and the third frequency band is from 5925 MHz to 7125 MHz.

14. The mobile device as claimed in claim 12, wherein a length of the first closed slot is substantially equal to 0.5 wavelength of the first frequency band.

15. The mobile device as claimed in claim 12, wherein a length of the second closed slot is substantially equal to 0.5 wavelength of the third frequency band.

* * * * *